US009564714B1

(12) United States Patent
Wang et al.

(10) Patent No.: US 9,564,714 B1
(45) Date of Patent: Feb. 7, 2017

(54) SERIAL-ATTACHED SCSI CONNECTOR

(71) Applicant: Amphenol East Asia Electronic Technology (Shen Zhen) Co., Ltd., Shenzhen (CN)

(72) Inventors: Xiang Wang, Shenzhen (CN); Fengcheng Qu, Shenzhen (CN); Fuan Jiang, Shenzhen (CN); Lei Liao, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/919,905

(22) Filed: Oct. 22, 2015

(51) Int. Cl.
*H01R 24/00* (2011.01)
*H01R 13/6461* (2011.01)
*H01R 13/6581* (2011.01)

(52) U.S. Cl.
CPC ..... *H01R 13/6461* (2013.01); *H01R 13/6581* (2013.01)

(58) Field of Classification Search
CPC ..... H01R 23/02; H01R 24/60; H01R 24/62
USPC ..... 439/947, 660, 941
See application file for complete search history.

(56) References Cited

U.S. PATENT DOCUMENTS 7,448,897 B2 * 11/2008 Dawiedczyk ..... H01R 13/6275 439/357
8,944,863 B1 * 2/2015 Yang ..... H01R 13/6585 439/607.08
9,077,118 B2 * 7/2015 Szu ..... H01R 24/00

* cited by examiner

*Primary Examiner* — Phuong Dinh
(74) *Attorney, Agent, or Firm* — Maier & Maier, PLLC

(57) ABSTRACT

An SAS connector which includes a male assembly, a female assembly and a PCB, the male assembly includes a male housing and several male signal terminals, the female assembly includes a female housing and several female signal terminals; the male assembly mates with the female assembly, with the PCB being clamped between the male assembly and the female assembly; wherein the male signal terminals are inserted in the male housing, and include in particular male symmetrical terminals, male right-biased terminals and male left-biased terminals, as well as female signal terminals that are inserted in the female housing, and include in particular female symmetrical terminals, female right-biased terminals and female left-biased terminals.

3 Claims, 3 Drawing Sheets

SERIAL-ATTACHED SCSI CONNECTOR

TECHNICAL FIELD

The present application relates to the field of Serial-Attached connector, particularly to a new SAS connector.

BACKGROUND

SAS (Serial-Attached SCSI or Sequential-Attached SCSI) is a new storage interface standard developed and maintained by ANSI INCITS T10 committee on the basis of Parallel-Attached SCSI physical storage interface. Compared with Parallel-Attached SCSI, SAS has advantages of higher transmission speed and simpler configuration. Furthermore, SAS is compatible with Sequential-Attached ATA (SATA) devices, and they can employ similar cables.

However, there are many defective aspects of existing SAS connectors remaining to be improved, which are specified as follows:

1. With continuous increase of data storage demands, the performance (clock frequency) of CPU keeps enhancing and the rising time is dramatically shortened, yet it remains a problem whether or not the connector's bandwidth (transmission rate) could meet these needs; and 2. When a signal is of extremely short rising edge or at high frequency and broad bandwidth, the connectors are susceptible to crosstalk problem.

SUMMARY

To solve the above mentioned problems, the present application provides a new SAS connector, which possesses the characteristics of broad bandwidth (i.e., high transmission rate) and strong anti-crosstalk capability.

In order to solve the above described problems, the present application particularly provides the following technical solution.

A new SAS connector comprises a male assembly, a female assembly and a PCB. The male assembly includes a male housing and several male signal terminals. The female assembly includes a female housing and several female signal terminals.

The male assembly can mate with the female assembly, and the PCB is clamped between the male assembly and the female assembly.

The male signal terminals are inserted in the male housing, and include in particular male symmetrical terminals, male right-biased terminals and male left-biased terminals. The male symmetrical terminal, male right-biased terminal and male left-biased terminal of the female signal terminals are positioned one after another in a repeating manner.

The female signal terminals are inserted in the female housing, and include in particular female symmetrical terminals, female right-biased terminals and female left-biased terminals. The female symmetrical terminal, female right-biased terminal and female left-biased terminal of the female signal terminals are positioned one after another in a repeating manner.

In a preferred technical solution, the female assembly includes several female power-source terminals, a first conductive resin plate and a second conductive resin plate, and the female housing includes a female signal terminal area and a female power-source terminal area.

The female signal terminals and the female power-source terminals are respectively inserted in the female signal terminal area and the female power-source terminal area. Additionally, each of the female power-source terminals is symmetrical.

The first conductive resin plate and the second conductive resin plate are both snapped at the outside of the female signal terminal area, and conductively connect with ground terminals.

In a preferred technical solution, the male assembly includes several male power-source terminals, and each of the male power-source terminals is symmetrical.

In a preferred technical solution, the male housing includes a male signal terminal area and a male power-source terminal area. The male signal terminals and the male power-source terminals are respectively inserted in the male signal terminal area and the male power-source terminal area.

In a preferred technical solution, the male housing and the female housing are made of plastic.

In a preferred technical solution, the male assembly includes at least one male fastening plate, and the female assembly includes at least one female fastening plate.

The at least one male fastening plate and the at least one female fastening plate are respectively clamped at either side of the male housing and the female housing. Upon assembly, the male fastening plate and the female fastening plate on the same side can be tightened together by a screw.

With the above mentioned technical solutions, the present invention could achieve several advantageous effects. Compared with the technical solutions in prior art, the technical solutions of the present invention have the following advantages. Firstly, compared with Parallel-Attached SCSI, Serial-Attached SCSI provides higher transmission speed and simpler configuration. Secondly, the present connector is optimized in its whole structure, especially with its male assembly being manufactured in a gold-finger injection molding manner, and with the conductive resin of special structure in the female assembly, the transmission rate of the present connector can be increased as high as 22.5 Gbps. Thirdly, the male power-source terminals and the female power-source terminals employ asymmetrical structures, the male power-source terminals and the female power-source terminals include symmetrical terminals, right-biased terminals and left-biased terminals, and these three kinds of terminals are located in the order of symmetrical terminal, right-biased terminal and left-biased in a repeating manner, so that the male power-source terminals and the respective female power-source terminals match more closely with each other to enhance the coupling effect of the differential pair, accordingly solving the problem of connectors susceptible to crosstalk when the signal is at extremely short rising edge or high frequency and broad bandwidth. Finally, upon assembly, the terminals are pushed downward, at this time, the conductive resin plates with their special structures make the curved ends of the terminals close to themselves to increase the conductive contact area of the terminals and thus solve the crosstalk problem.

DETAILED DESCRIPTION

The present invention will now be described in detail with reference to the specific embodiments, taken in conjunction with FIG. 1 to FIG. 5. However, the description and figures are not intended to limit the scope of the present application.

Embodiment 1

Figure 1:
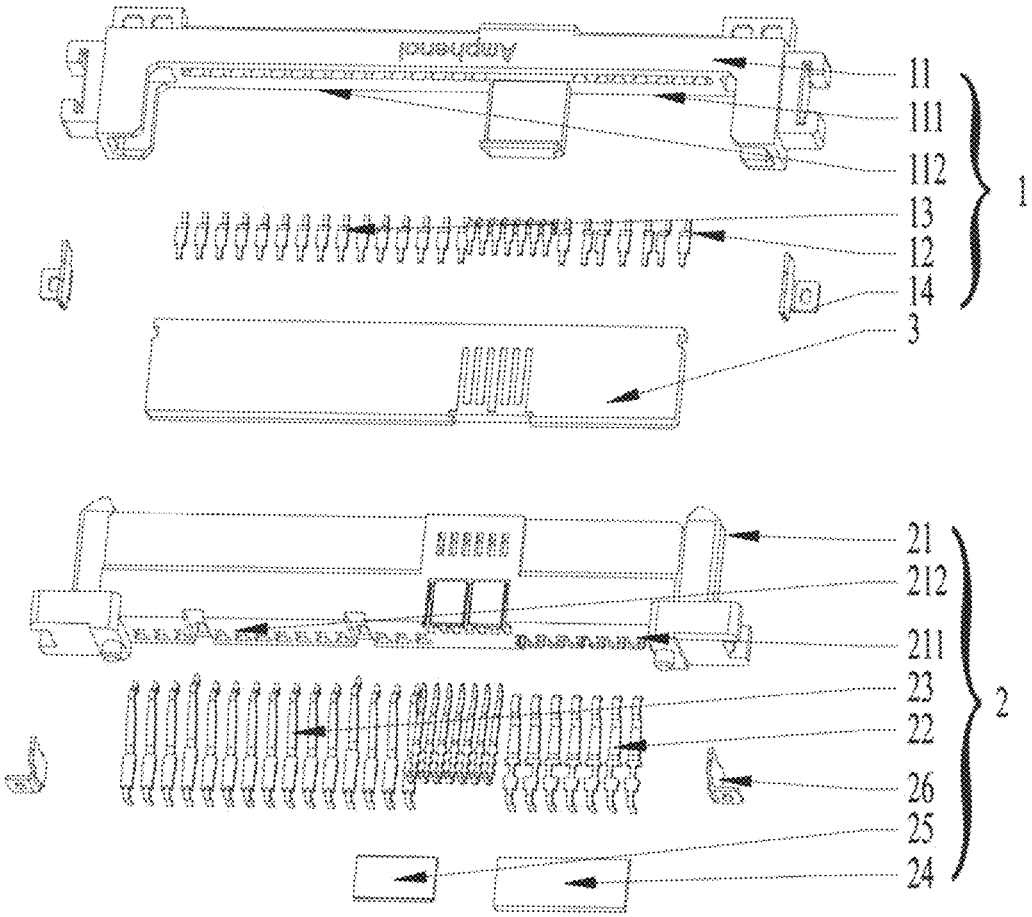
FIG. 1 is an exploded view of a new SAS connector.

As shown in FIG. 1, a new SAS connector comprises a male assembly 1, a female assembly 2 and a PCB 3. The male assembly 1 includes a male housing 11, several male signal terminals 12 and several male power-source terminals 13. The female assembly 2 includes a female housing 21, several female signal terminals 22 and several female power-source terminals 23, a first conductive resin plate 24 and a second conductive resin plate 25.

The male assembly 1 can mate with the female assembly 2, and the PCB 3 is clamped between the male assembly 1 and the female assembly 2. The male housing 11 is made of plastic and includes a male signal terminal area 111 and a male power-source terminal area 112. The female housing 21 is made of plastic and includes a female signal terminal area 211 and a female power-source terminal area 212.

Figure 2:
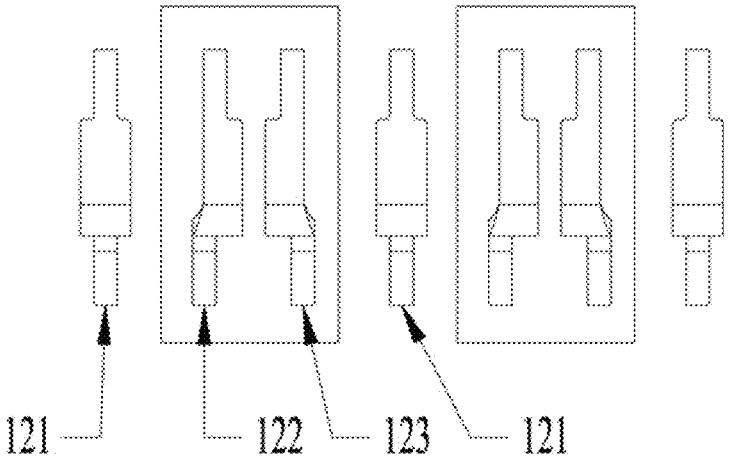
FIG. 2 shows the male signal terminals (male symmetrical type, male right-biased type and male left-biased type).

As shown in FIG. 2, the male signal terminals 12 and the male power-source terminals 13 are respectively inserted into the male signal terminal area 111 and the male power-source terminal area 112. The male signal terminals 12 include in particular male symmetrical terminals 121, male right-biased terminals 122 and male left-biased terminals 123. The male symmetrical terminal 121, male right-biased terminal 122 and male left-biased terminal 123 of the male signal terminals 12 are positioned one after another in a repeating manner. Additionally, the male power-source terminals 13 are each symmetrical.

As shown in FIG. 1 and FIG. 2, the female signal terminals 22 and the female power-source terminals 23 are respectively inserted into the female signal terminal area 211 and the female power-source terminal area 212. The female signal terminals 22 include in particular female symmetrical terminals, female right-biased terminals and female left-biased terminals. The female symmetrical terminal, female right-biased terminal and female left-biased terminal of the female signal terminals 22 are positioned one after another in a repeating manner. Additionally, the female power-source terminals 23 are each symmetrical.

Figure 3:
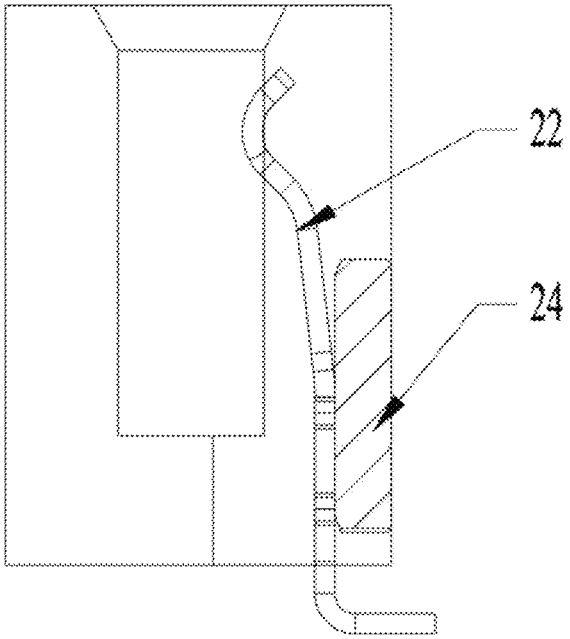
FIG. 3 shows the conductive resin plates.

As shown in FIG. 1 and FIG. 3, the first conductive resin plate 24 and the second conductive resin plate 25 are both snapped at the outside of the female signal terminal area 211, and conductively connect with ground terminals.

Embodiment 2

Figure 4:
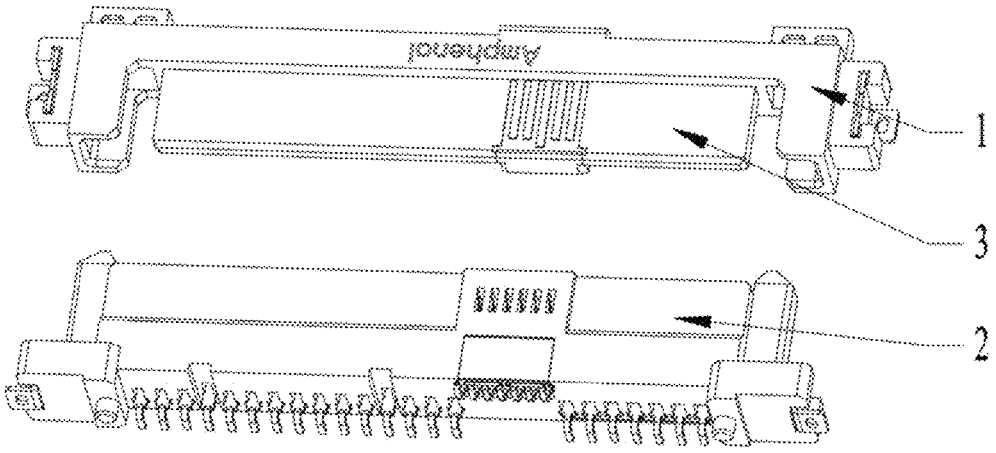
FIG. 4 is a perspective view (observed from front side) of the new SAS connector.
Figure 5:
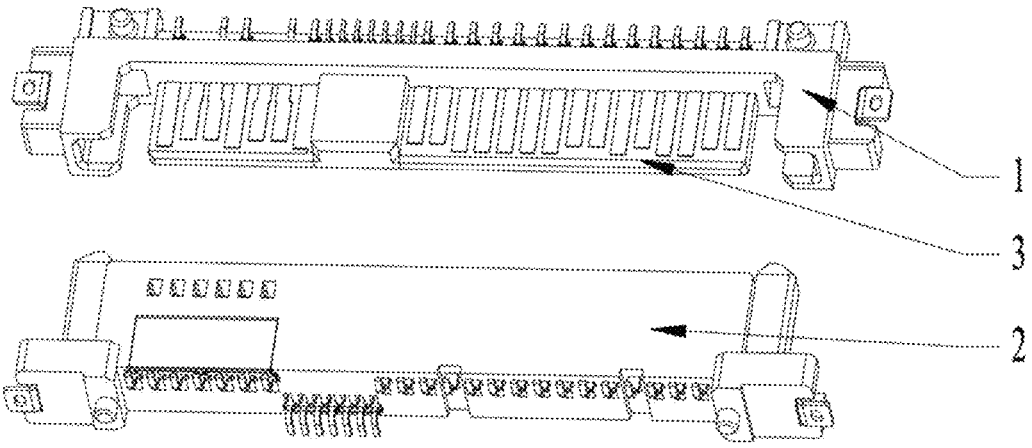
FIG. 5 is a perspective view (observed from back side) of the new SAS connector.

As shown in FIGS. 1, 4 and 5, on the basis of embodiment 1, the male assembly 1 further includes two male fastening plates 14, and the female assembly 2 further includes two female fastening plates 26. The two male fastening plates 14 and the two female fastening plates 26 are respectively clamped at the two sides of the male housing 11 and the female housing 21. Upon assembly, the male fastening plate 14 and the female fastening plate 26 on the same side can be tightened together by a screw.

From the common knowledge in the art, the present invention can be realized by other embodiments which do not depart from the spirit and essential features of the application. Therefore, under any circumstances, the above disclosed embodiments are intended for the purpose of illustration only and are not intended to be exhaustive. The modifications and variations within the scope of the application or its equivalents will fall within the protection scope of the invention.

The invention claimed is:

1. An SAS connector comprising: a male assembly, a female assembly and a PCB, the male assembly including a male housing and several male signal terminals, the female assembly including a female housing and several female signal terminals;

the male assembly being able to mate with the female assembly, with the PCB being clamped between the male assembly and the female assembly, the male assembly comprising several male power-source terminals, and the male power-source terminals are centrally symmetrical;

wherein the male signal terminals are inserted in the male housing, and comprise male symmetrical terminals, male right-biased terminals and male left-biased terminals, the male symmetrical terminal, the male right-biased terminal and the male left-biased terminal of the male signal terminals are positioned one after another in a repeating manner;

wherein the female signal terminals are inserted in the female housing, and comprise female symmetrical terminals, female right-biased terminals and female left-biased terminals, the female symmetrical terminal, the female right-biased terminal and the female left-biased terminal of the female signal terminals are positioned one after another in a repeating manner.

2. The SAS connector according to claim 1, wherein the female assembly further comprises several female power-source terminals, a first conductive resin plate and a second conductive resin plate, the female housing comprises a female signal terminal area and a female power-source terminal area;

wherein the female signal terminals and the female power-source terminals are respectively inserted in the female signal terminal area and the female power-source terminal area;

wherein the female power-source terminals are centrally symmetrical.

3. The SAS connector according to claim 1, wherein the male housing comprises a male signal terminal area and a male power-source terminal area; the male signal terminals and the male power-source terminals are respectively inserted in the male signal terminal area and the male power-source terminal area.

* * * * *